US005778546A

United States Patent [19]

Williamson

[11] Patent Number: 5,778,546

[45] Date of Patent: Jul. 14, 1998

[54] CONSTRUCTION ALIGNMENT APPARATUS AND METHOD

[76] Inventor: Richard L. Williamson, 942 SE. 5th St., Ocala, Fla. 34471

[21] Appl. No.: 642,630

[22] Filed: May 3, 1996

[51] Int. Cl.[6] ..... E04G 21/18

[52] U.S. Cl. ..... 33/405; 33/413; 33/1 H

[58] Field of Search ..... 33/1 G, 1 H, 1 LE, 33/339, 405, 406, 413, 288, 608

[56] References Cited

U.S. PATENT DOCUMENTS

| | | | |
|---|---|---|---|
| Re. 24,044 | 7/1955 | Breuninger . | |
| 1,130,926 | 3/1915 | Peck | 33/1 H |
| 1,320,352 | 10/1919 | Werner | 33/1 H |
| 1,609,912 | 12/1926 | Mazeau | 33/1 H |
| 2,758,379 | 8/1956 | Senk . | |
| 2,934,826 | 5/1960 | Klaum | 33/1 LE |
| 3,381,379 | 5/1968 | Fergen | 33/1 LE |
| 3,861,046 | 1/1975 | Arn | 33/405 |
| 4,080,739 | 3/1978 | Ruhaak | 33/1 LE |
| 4,095,343 | 6/1978 | McPhail | 33/1 LE |
| 4,322,890 | 4/1982 | Jarman et al. | 33/608 |
| 4,932,134 | 6/1990 | Meadows | 33/1 H |
| 4,958,814 | 9/1990 | Johnson . | |
| 5,119,565 | 6/1992 | Horvath et al. | 33/405 |

FOREIGN PATENT DOCUMENTS

| | | | |
|---|---|---|---|
| 389258 | 7/1965 | Switzerland | 33/1 LE |
| 700207 | 11/1953 | United Kingdom | 33/413 |
| 715062 | 9/1954 | United Kingdom | 33/413 |

*Primary Examiner*—Thomas B. Will

*Attorney, Agent, or Firm*—Allen, Dyer, Doppelt, Milbrath & Gilchrist, P.A.

[57] ABSTRACT

An adjustable batter board used in locating forms and trenches for pouring foundations and constructing walls includes an elongated tubular cross member having holes passing from a top to a bottom surface at each end of the cross member for receiving reinforcing rods therethrough. The rods pass through the top and bottom holes within the tubular cross member and through an eye of an eyebolt positioned within the tubular cross member and aligned with the top and bottom holes. With the rods driven into the ground at desired locations, adjustment of the batter board to a desired vertical location on the rods is made and the eyebolts at each end of the member are forced outwardly toward a tube end through the tightening of a nut at the eyebolt threaded end for biasing the rod against a hole side wall and thus securing the batter board the rods. A U-clamp styled slide member moveable along the cross member outside surface includes a slot for permitting an alignment string to be positioned onto the cross member top surface. The slide member further includes a bolt passing between ends of the clamp for biasing the ends against the cross member for securing the string position.

23 Claims, 6 Drawing Sheets

FIG. 9
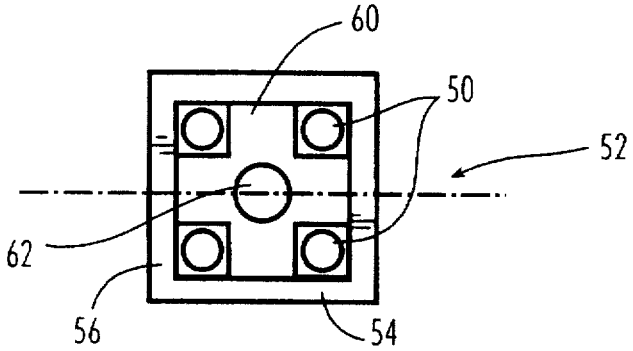
FIG. 10
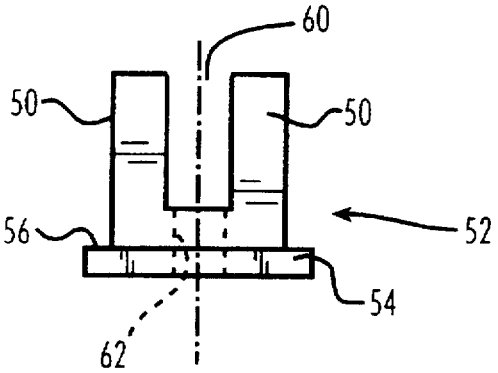
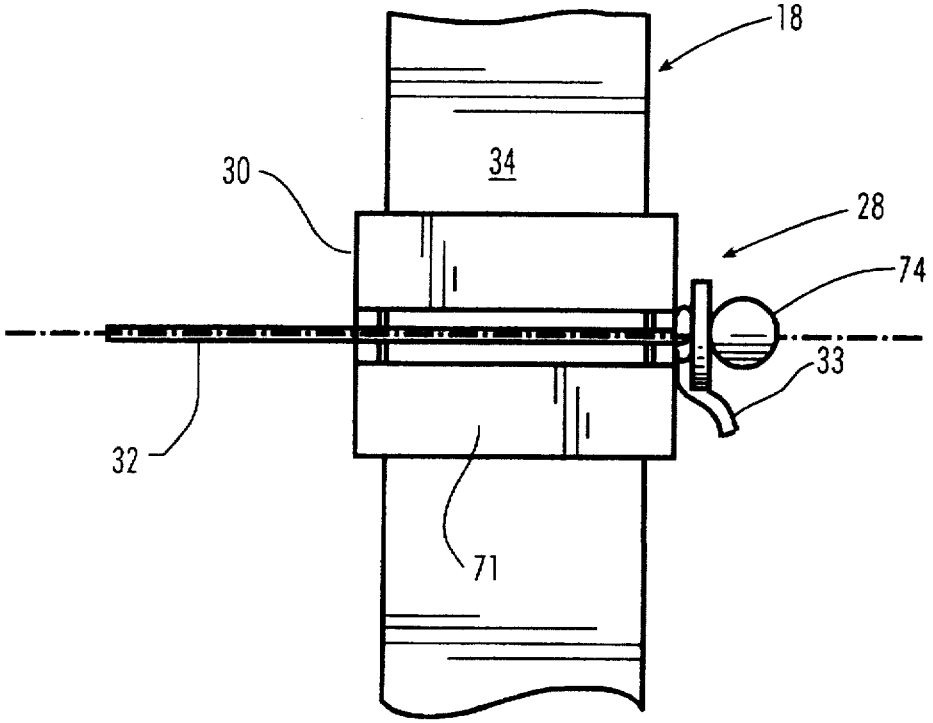
FIG. 11

CONSTRUCTION ALIGNMENT APPARATUS AND METHOD

BACKGROUND OF INVENTION

1. Field of Invention

The invention relates generally to construction aids used in the building trades and more particularly to an alignment tool for aligning building construction layout lines.

2. Description of Background Art

Traditionally, batter boards are erected at the corners of a building foundation or ground area over which horizontal lines, typically a string material, are stretched to define the overall footprint of the building including the position of walls. In earlier years and as often continues today because of the convenience and availability of materials at the construction site, 2×4 board lumber is cut for use as vertical stakes hammered into the ground, typically three or four at each corner or significant change in the buildings footprint. Batter boards, horizontal 2×4 sections are then nailed between the clustered vertical stakes and string stretched from horizontal board to horizontal board, typically wrapped around a nail within a top surface of the horizontal board for establishing a reference elevation and wall location. The inconvenience in having to remove and replace nails, remove and adjust the stakes, and repeat until a proper or desired alignment was obtained led to alternate forms of the batter board.

Such batter boards have been used to determine desired levels and for anchoring strings for alignment of varied and often complicated projects. As is well known in the construction industry, such batter boards are difficult to use because they are nailed to the stakes and as a result are difficult to accurately adjust. Also, because the batter board is nailed to the stake, the board and stake tend to crack and break and typically will not be reused, wasting the time and effort employed in fabricating the batter board system parts. Further, the inconsistency resulting leads to inaccuracy in positioning the alignment string and in locating foundation or building perimeter locations.

As is well accepted in the construction trades, there is a need for an adjustable batter board which uses a stake that can be conveniently moved and driven into the ground repeatedly without concern for cracking.

U.S. Pat. Re. No. 24,044 to Breuninger discloses a batter board having elongated, straight, vertical corner posts formed from a section of angle iron including integrally connected webs disposed at right angles to each other and defining a square corner. The webs elongated longitudinal parallel slots which have elongated, straight, horizontal strips or batter boards attached at their ends using wing nuts to facilitate their adjustment. The batter boards are provided with notches spaced along their top longitudinal edges for positioning layout lines.

U.S. Pat. No. 4,932,134 to Meadows discloses an adjustable foundation locating device used to position forms and trenches which includes a horizontal member supported by a stake driven into the ground. The horizontal member is vertically adjusted until located at a desired level and then secured in place to the stake by tightening a bolt threaded into a bracket attached to the horizontal member. A sleeve member is slidable along the horizontal member for horizontally positioning alignment string extended between cooperating horizontal members. The string is attached to nails extending from the sleeve members.

U.S. Pat. No. 3,861,046 to Arn addresses the need for providing a batter board construction formed of reusable, readily fabricated metal components which are relatively inexpensive to manufacture and assemble. A batter board is described that includes a horizontal tubular cross member adjustably supported at opposite ends by U-shaped brackets on a pair of vertical metal posts adapted to be driven into the ground. Angle braces are mounted on opposite ends of the cross member adjacent the vertical posts and extend outwardly and downwardly into the ground to provide reinforcement. A slide member is movably mounted on the cross member and is provided with an upwardly vertical extending transit sight and construction line tie pin. A separate locking screw is provided on the slide member for clamping the slide member in adjusted positions on the cross member.

The industry need continues for an inexpensive, durable batter board or alignment tool that uses readily available and replaceable metal components. Further, the need exists for such an apparatus to be easily assembled using interchangeable components and preferable easily replaceable and readily available stakes. Such needs are satisfied by the present invention.

SUMMARY OF INVENTION

A primary object of the present invention is to provide an improved batter board which includes the use of readily available components and includes material typically available at construction sites. It is further an object of the invention to provide a batter board that can incorporate inexpensive reinforcing rods for use as vertical posts or stakes for securing the batter board. It is yet another object to provide a batter board that is easily and quickly assemble on site. It is further an object to provide a batter board construction using components that are secured within the board assembly for reducing component losses. It is yet another object to provide for positioning of the alignment string onto a reference plane of the batter board. Other objects and advantages of the invention will be apparent during the course of the following description.

These objects and advantages are obtained by the apparatus, the general nature of which may be stated as comprising a cross member having first and second end portions, each end portion having a passage passing transversely through cross member side walls for receiving an elongate rod and passing the rod through the cross member at an angle generally perpendicular to the member and biasing means for engaging the rod within the passage for placing the rod in frictional contact with passage walls. In an embodiment of the present invention, the biasing means is positioned substantially within the cross member for engaging the rod and providing a biasing force along a longitudinal axis of the cross member.

In one embodiment described in detail herein, the biasing means comprises an eye bolt having a threaded shaft portion and a head including an aperture sufficient for receiving the rod therethrough wherein the eyebolt is longitudinally positioned within the cross member for placing the head within the passage for receiving the rod through the aperture. A plate is positioned against a cross member end and includes a hole for receiving the eye bolt shaft therethrough. A nut is threaded on the shaft for driving the shaft longitudinally along the cross member and biasing the rod passing through the eyebolt aperture against the passage wall.

In a preferred embodiment described, guiding means is included for limiting rotation of the eyebolt shaft and holding the eyebolt head within a plane generally perpendicular to the rod passing through the passage, thus permitting generally smooth passing of the rod through the aperture.

BRIEF DESCRIPTION OF DRAWINGS

A preferred embodiment of the invention, illustrative of the best mode contemplated, as well as alternate embodiments are set forth in the following description and described by way of example with reference to the accompanying drawings in which:

FIG. 9 is an end view of an element of the embodiment FIG. 1;

FIG. 10 is a side view of the element of FIG. 9;

FIG. 11 is a partial top view of the embodiment of FIG. 1 further illustrating features of a slide element of the present invention;

DETAILED DESCRIPTION OF PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
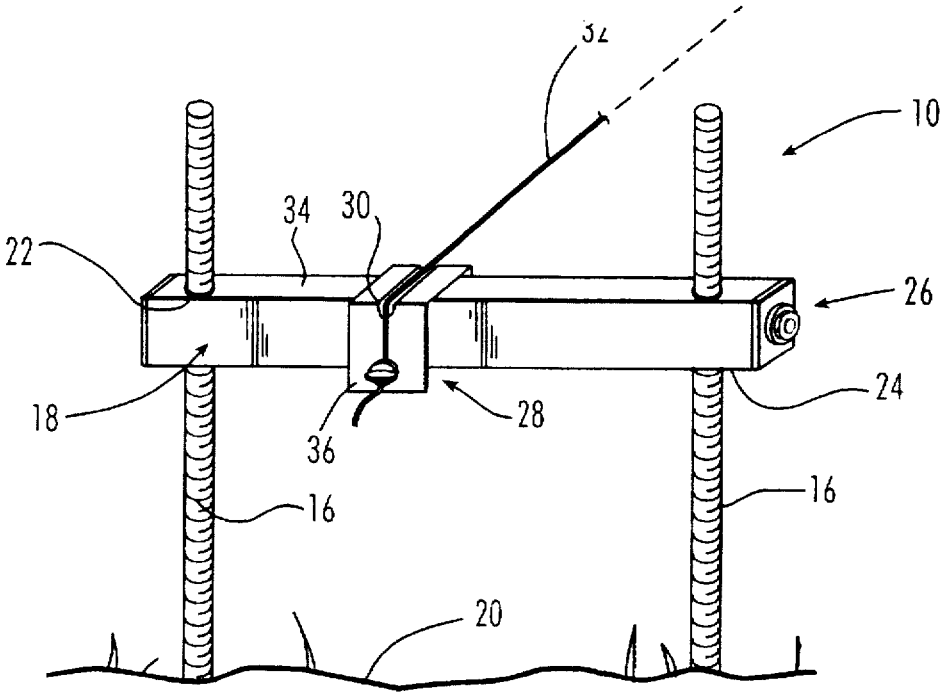
FIG. 1 is a perspective view of an embodiment of the present invention.
Figure 2:
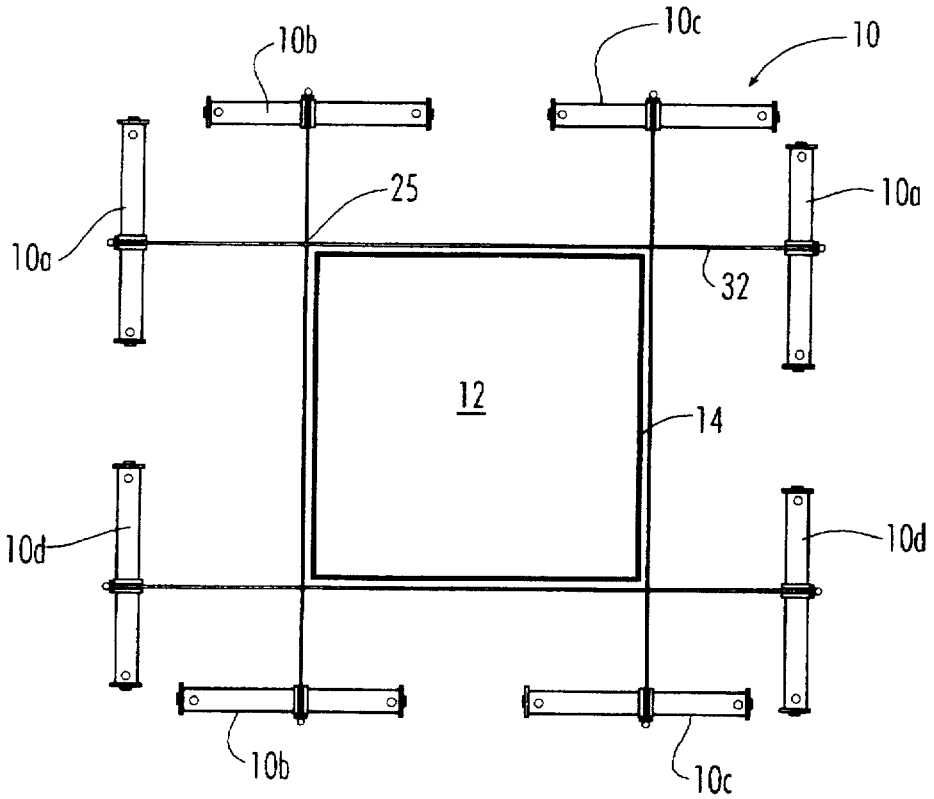
FIG. 2 is a schematic view illustrating use of the apparatus of FIG. 1 for locating corners of a building foundation, by way of example.

Referring now to FIG. 1, a preferred embodiment of the present invention, a construction alignment apparatus 10 is illustrated by way of example, in a batter board styled use typically for positioning a foundation 12 within a trench 14 defining the foundation 12 as illustrated with reference to FIG. 2 . It is anticipated that elongate reinforcing rods 16, typically referred to as "rebar" will be used to position a tubular member 18 above a supporting ground surface 20.

In the preferred embodiment of the present invention, the tubular member 18 includes a generally square cross-section. However, it is anticipated that any rectangular or circular cross-section will be used in alternate embodiments. Further, channel iron having three walls is appropriate for such use as will be realized with this detailed description.

Again with reference to FIG. 1, the tubular member 18 includes holes 22 at end portions 24 of the tubular member 18. As will be described in detail later in this section, the holes 22 are sized for loosely receiving the rod 16 and passing the rod 16 transversely through the tubular member 18. With the rods 16 driven into the ground 20, the tubular member 18 is held at a position above the ground 20 using biasing means 26 operational at end portions 24 of the tubular member 18. As will be described in detail later in this section, the biasing means 26 holds the rod 16 in frictional contact with a hole side wall portion. The preferred embodiment of the apparatus 10 further includes a U-shape slide member 28 having a slot 30 for receiving flexible line or layout string 32 and guiding the string 32 onto an alignment or leveling surface 34 of the tubular member 18. As will be described later in this section, the slide member 28 includes clamping means 36 for holding the slide member at a desired location on the tubular member 18.

Again with reference to FIG. 2, in use and described herein by way of example, multiple apparatus 10 are positioned for attaching the string 32 between cooperating apparatus (e.g. 10*a*—10*a*, 10*b*—10*b*, etc.). The string 32 is then used to define the trench 14 from which the foundation 12 is formed. The string 32 attached between the cooperating apparatus 10*a*, 10*b*, 10*c*, 10*d* shown here by way of example typically define corners 25 for the foundation 12 or building structure to be placed on a site. Each tubular member 18 of each of the apparatus 10*a*–10*d* is placed onto the ground surface 20 with the holes 22 facing upward for receiving the rod 16 and passing the rod 16 transversely through the tubular member 18 and generally vertically into the ground surface 20, as illustrated again with reference to FIG. 1, each cooperating tubular member 18 being located for defining the trench 14 or foundation 12. The elongated rods 16 are then passed through the holes 22 at each end of each tubular member and are driven generally vertically into the ground surface 20. The tubular member 18 is then raised to a desired height, leveled and secured to the rods 16 using the biasing means 26. The string 32 is passed over the alignment surface 34 and secured to the slide member 28 as will later be described in further detail. The string 32 is then pulled taut while passing the string 32 over a top surface 34 of a cooperating apparatus 10 for defining the trench 14 or edge of foundation 12 running along the string 32.

Figure 3:
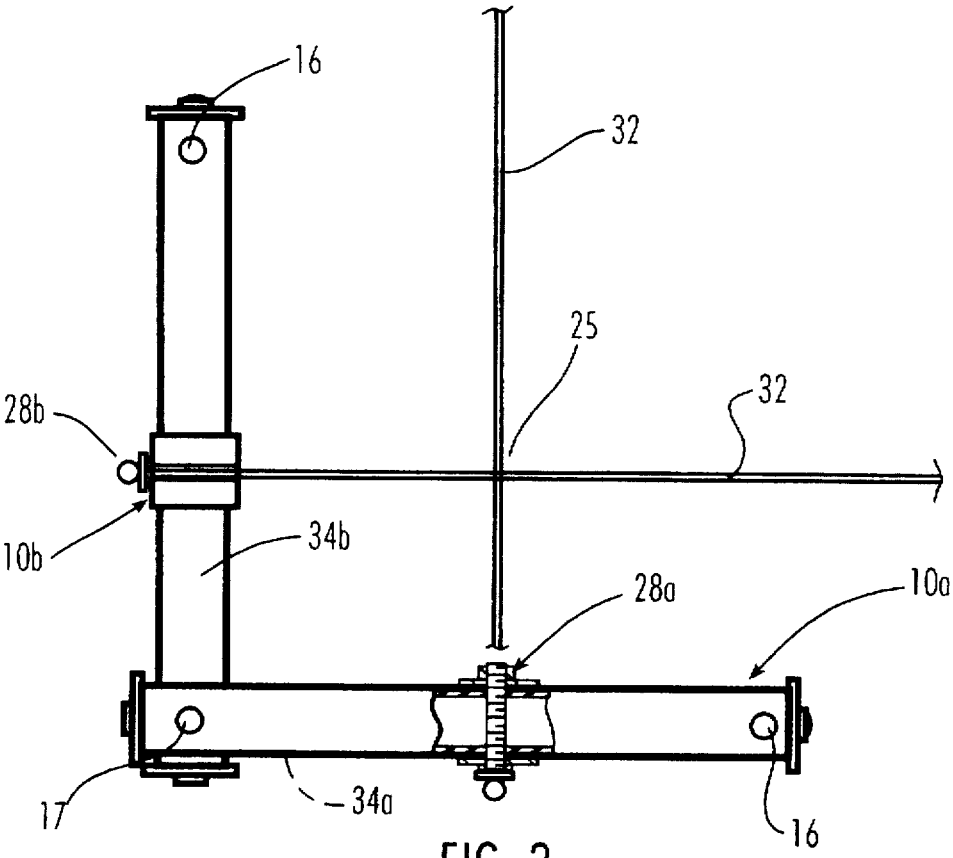
FIG. 3 is a top plan view of an alternate configuration of the apparatus of FIG. 1.

In an alternate apparatus and as illustrated with reference to FIG. 3, a common corner rod 17 is shared by corner apparatus 10*a* and 10*b* for defining the corner 25. When it is important for the string 32 and corners 25 to be held within a single plane, one apparatus 10*a* or the slide member 28*a* is rotated and positioned for holding the string 32 against top surfaces 34*a*, 34*b* which are in contact with each other.

Figure 4:
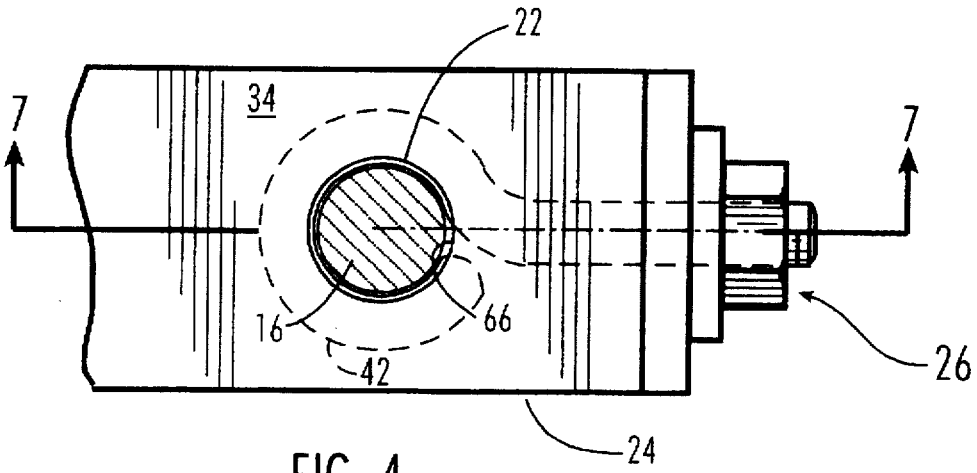
FIG. 4 is an enlarged partial top plan view of an end portion of the embodiment in FIG. 1, the bottom view being a mirror image.
Figure 5:
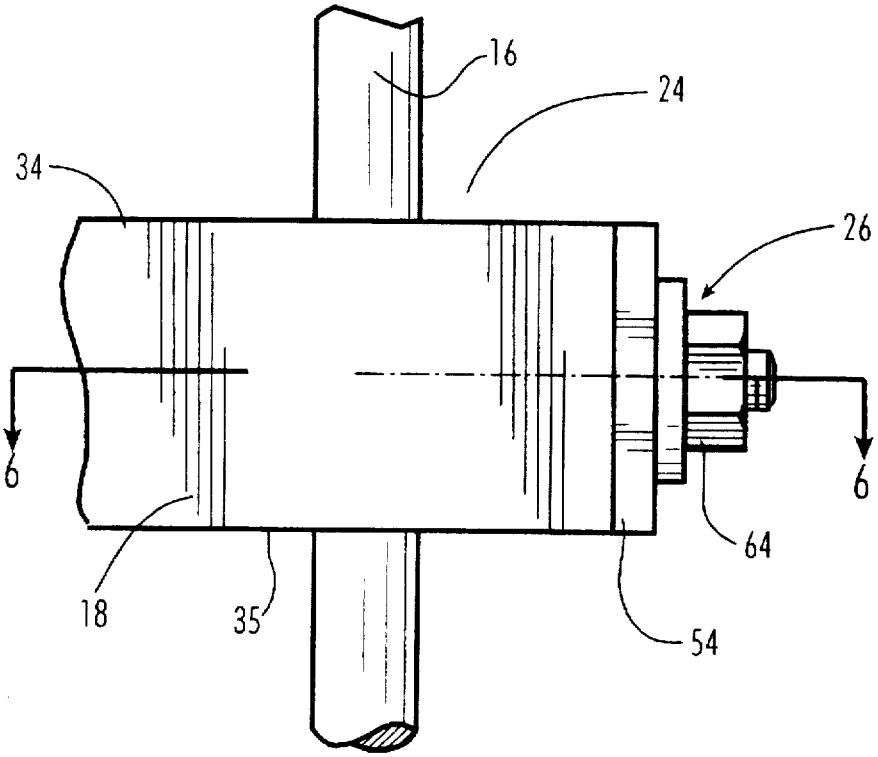
FIG. 5 is an enlarged partial front elevational view of the end portion of FIG. 4, the opposing rear view being a mirror image.
Figure 6:
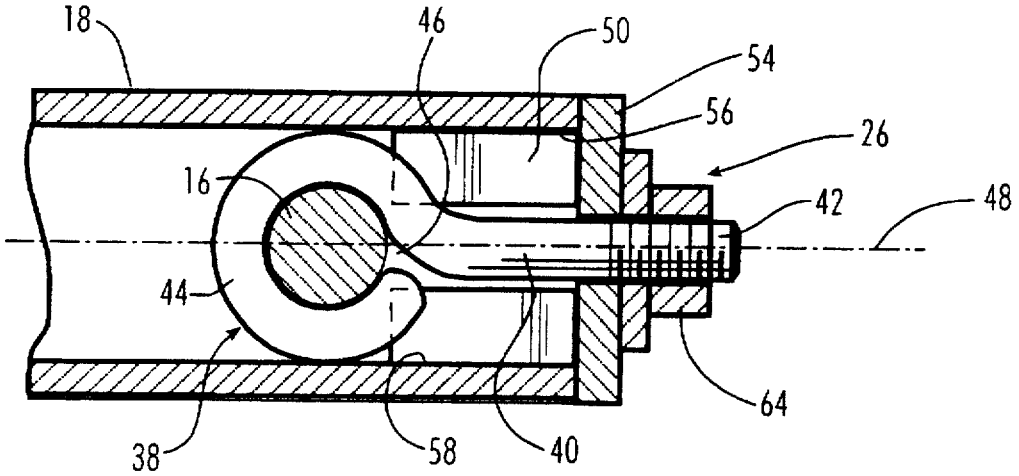
FIG. 6 is a partial top plan cross-sectional view through cut 6—6 of FIG. 5.
Figure 7:
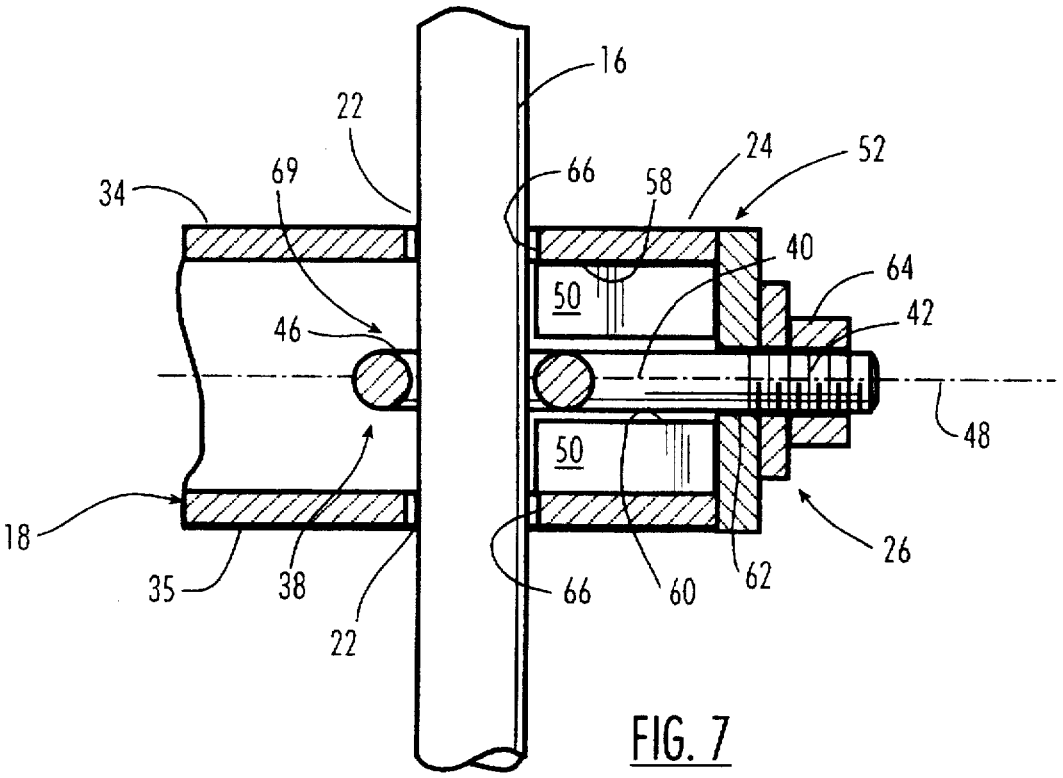
FIG. 7 is a partial front elevational cross-sectional view through cut 7—7 of FIG. 4 illustrating a loosely fit rod passing through a hole within the apparatus.
Figure 8:
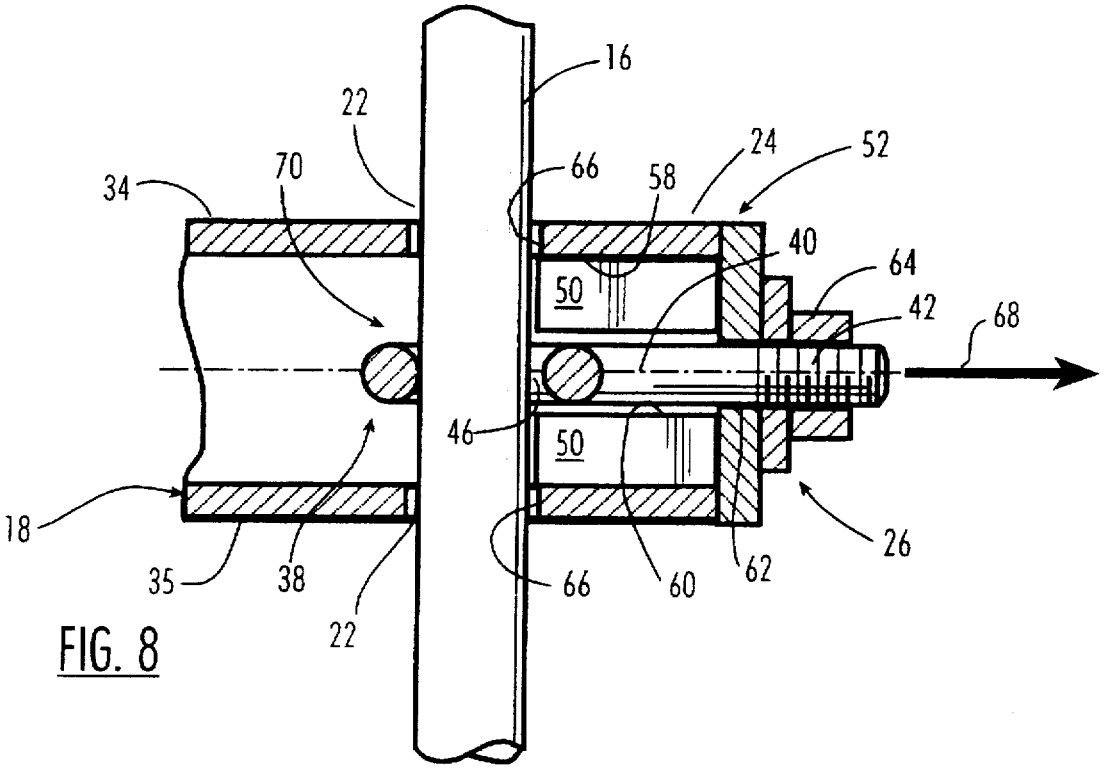
FIG. 8 is the partial front view of FIG. 7.

To further describe the biasing means 26 of a preferred embodiment of the apparatus 10, reference is now made to FIGS. 4–10, of which FIGS. 4 and 5 illustrate partial top and front views of the tubular member end portion 24, and FIGS. 6 and 7 illustrating cross-sectional views taken through cuts 6—6 and 7—7 of FIGS. 5 and 4 respectively. As illustrated with reference to FIGS. 6 and 7, the biasing means 26 in the preferred embodiment described herein includes an eyebolt 38 having a shaft 40 and threaded shaft portion 42 and a head 44 having an aperture 46 sufficient for loosely receiving the rod 16 therethrough. The eyebolt 38 is positioned within the tubular member 18 having the shaft 40 generally aligned along a longitudinal axis 48 of the tubular member 18 for receiving the rod 16 through the aperture 48. The head 44 is guided between opposing guide elements 50 for holding the aperture 46 generally within an imaginary plane positioned between parallel to the top wall 34 and bottom wall 35 for cooperating with the holes 22 therein and thus permitting passage of the rod 16 therethrough without interference from an inadvertently rotated head 42. An end cap 52 includes a plate 54 having the guide elements 50 integrally formed with the plate 52 as illustrated with reference to FIGS. 9 and 10. The guide elements 50 form a flange portion 56 which is received by inside tubular walls 58 for positioning the end cap 52 onto the tubular member 18. A separation between the guide elements 50 provides a slot 60 within which a portion of the head 42 is positioned as illustrated again with reference to FIGS. 6 and 7. A hole 62 within a center portion of the plate 54 receives the threaded shaft portion 42. The shaft portion 42 extends outward of the plate for receiving a nut 64 which in the preferred embodiment includes a lock nut and washer. The nut 64 is threaded onto the threaded shaft portion 42 for driving the shaft 40 longitudinally outward from the tubular member 18 for biasing the nut 64 against the plate 54 and thus biasing the rod 16 passing through the eyebolt aperture 44 against a hole side wall 66.

Again with reference to FIG. 7, the rod 16 is illustrated as loosely passing through the holes 22 within the top wall 34 and bottom wall 35 of the tubular member 18, and loosely through the aperture 46 of the eyebolt 38. By tightening the nut 64 and biasing it against the plate 54, the eyebolt 38 and thus aperture 46 is directed outward, indicated by arrow 68 of FIG. 8. By continuing this process, the rod 16 held within the aperture 46 is moved from its loosely held position 69 as illustrated with reference to FIG. 7, to its secured position 70, as illustrated with reference to FIG. 8. In such a secured position 70, the rod 16 is frictionally held against the hole side walls 66, forced against the side walls 66 by the action of the head 44 pulling the rod 16 in the outward direction 68. It is anticipated that those skilled in the art will direct the rod 16 against hole side walls 66 using alternate biasing means such as directing the eyebolt 38 inward along the axis 48 or transverse to the tubular axis 48 depending on the appropriate need.

Figure 12:
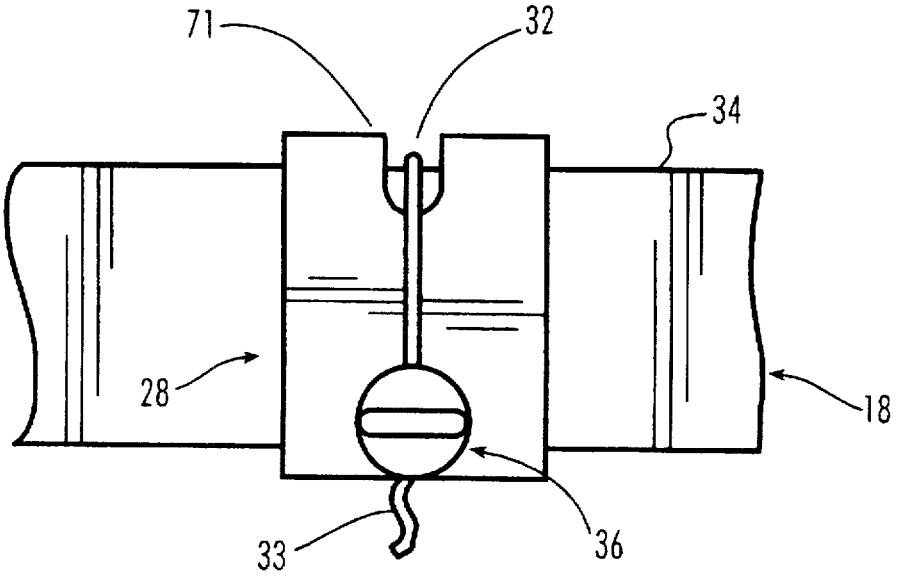
FIG. 12 is a front side elevational view of the slide element of FIG. 11.
Figure 13:
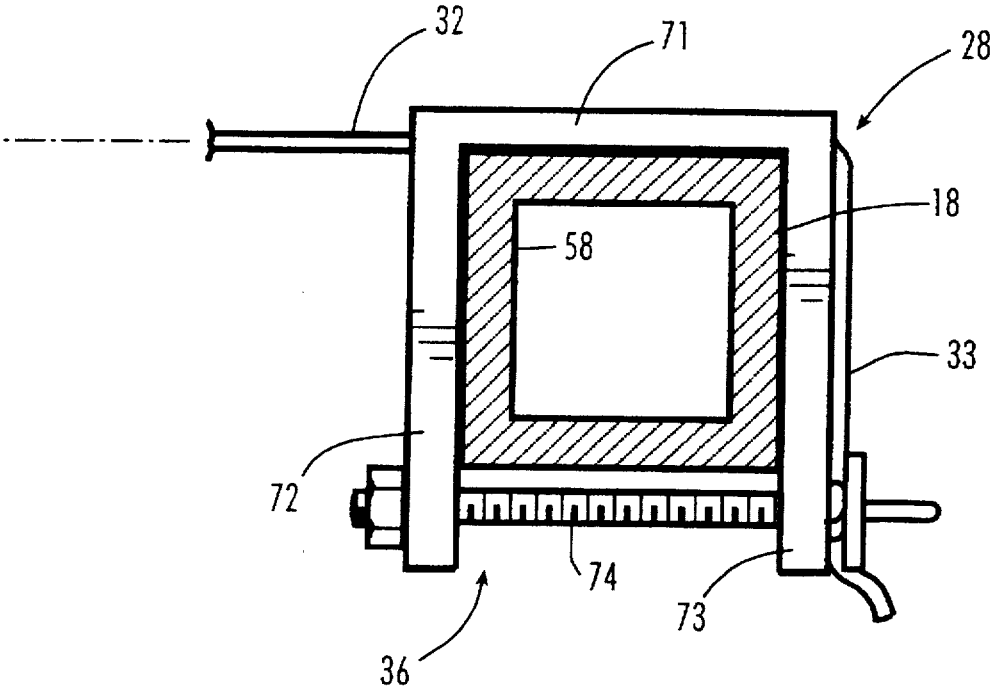
FIG. 13 is an end view of the slide element of FIG. 11, the opposing end view being a mirror image.

As described earlier with reference to FIG. 1, the preferred embodiment of the present invention includes a U-shape slide member 28 having a slot 30 for receiving the layout string 32 and guiding the string 32 onto the alignment or leveling surface 34 of the tubular member 18. The slide member 28 includes clamping means 36 for holding the slide member at a desired location on the tubular member 18. With reference to FIGS. 11–13, enlarged drawings of the slide member 28 are illustrated. As illustrated with reference to FIGS. 11 and 12, the slot 30 receives the string 32 therein and permits the string to be positioned against the alignment surface 34 of the tubular member 18. In the arrangement of FIG. 1, the alignment surface is the tubular member top surface 34 as herein described but as illustrated with reference to FIG. 3, the alignment surface of the apparatus 10*a* will be the bottom surface. With the string 32 pulled taut over the alignment surface 34, an end of the string 33 is secured to the tubular member 18 or a portion of the slide member 28.

The slide member 28 provides a means for attaching the string 32 to the apparatus 10 and holding the string onto the alignment or top surface 34. The slide member has an arm portion 71 adapted for slidable movement along the top surface 34. The slot 30 extends through the arm portion 71 transversely across the top surface 34 for receiving the string 32 and positioning it onto the top or alignment surface 34 as earlier described. Opposing flexible clamp arms 72, 73 extending from the slide arm pass around a peripheral portion of the tubular member 18 loosely receive the member 18 therebetween permitting the slidable movement. Once at a selected position, the slide member 28 is clamped and held firm against the tubular member side walls through the clamping action of the slide member opposing clamping arms 72, 73 biasing against the tubular member side walls through the action of a screw 74 rotatably attached between clamp arm end portions as illustrated with reference to FIG. 13.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

What is claimed is:

1. A construction alignment apparatus comprising:

a rectangular tubular member having opposing top and bottom walls, each wall having a hole for receiving an elongate rod passing transversely through the tubular member; and biasing means for placing the elongate rod into frictional contact with a hole side wall for biasing the rod to the tubular member, the biasing means comprising an eyebolt having a threaded shaft portion and a head including an aperture for loosely receiving the elongate rod therethrough, the eyebolt positioned within the tubular member for receiving the rod and cooperating with the holes in the opposing top and bottom walls for passing the rod therethrough;

an end cap held within a tubular member end, the end cap having a plate positioned against the tubular member end, the plate further having a hole for receiving the eye bolt shaft therethrough; and a nut threaded onto the shaft for driving the shaft longitudinally along the tubular member for biasing the nut against the plate and thus biasing the rod passing through the aperture of the eyebolt against the hole side wall, the eyebolt moving from a first position wherein the elongate rod is loosely passing through the aperture to a second position wherein the rod is biased against the hole side wall thus securing the rod to the tubular member.

2. An apparatus according to claim 1, wherein the end cap further comprises guiding means cooperating with the eyebolt for limiting rotation of the shaft and holding the head within the plane thus permitting generally smooth passing of the rod through the holes and aperture.

3. An apparatus according to claim 2, wherein the guiding means comprises opposing guide elements extending from an end cap plate peripheral portion, the guide elements loosely receiving a portion of the eyebolt head therebetween.

4. An apparatus according to claim 1, further comprising an elongate rod adapted to be driven into the ground, the rod passing transversely through the tubular member for biasing against the hole side wall portions.

5. An apparatus according to claim 4, wherein the elongate rod comprises a rigid steel reinforcing rod.

6. An apparatus according to claim 1, further comprising alignment line attaching means for attaching a flexible alignment line to the tubular member, the attaching means adapted for positioning the alignment line onto the tubular member, the attaching means mounted on the tubular member and adapted for adjustable sliding movement therealong.

7. An apparatus according to claim 6, wherein the alignment line attaching means comprises:

a U-shape slide member having an alignment arm and opposing clamp arms extending from end portions of the alignment arm, the slide member adapted for slidable movement along an outside surface of the tubular member, the alignment arm having a slot passing therethrough for receiving the line therein and positioning the line onto the tubular member alignment surface portion, the slide member opposing flexible clamp arms extending along tubular side walls for loosely receiving the tubular member within the U-shape slide member; and a clamping screw cooperating between the opposing clamp arms for biasing the clamp arms against the tubular member side walls for frictional attachment thereto.

8. An apparatus for use in building construction comprising:

a cross member having first and second end portions, each end portion having a passage passing transversely through cross member side walls for receiving an elongate rod and passing the rod therethrough; and biasing means for engaging the elongate rod within the passage for placing the rod in frictional contact with a passage wall, the biasing means moving the rod from a first position wherein the rod is loosely passing through the passage to a second position wherein the rod is biased against the passage wall thus securing the rod to the cross member the biasing means comprising, a bolt having a threaded shaft portion and a head including an aperture for receiving the elongate rod therethrough, the bolt positioned within the cross member for having the aperture placed within the passage for receiving the rod therethrough;

a plate positioned against a cross member end, the plate having a hole for receiving the eye bolt shaft; and a nut threaded on the shaft for displacing the bolt and biasing the rod passing through the aperture of the head against the passage wall.

9. An apparatus according to claim 8, wherein the cross member further comprises a rectangular cross-section defined by four side walls and wherein the passage comprises holes within opposing side walls, the holes positioned for receiving the elongate rod therethrough and guiding the rod at a generally perpendicular angle.

10. An apparatus according to claim 8, further comprising guiding means for limiting rotation of the bolt thus holding the head within a plane generally perpendicular to the rod passing through the passage for permitting generally smooth passing of the rod through the aperture.

11. An apparatus according to claim 8, further comprising an elongate rod adapted to be driven into the ground, the rod passing through the passage.

12. An apparatus according to claim 11, wherein the elongate rod comprises a rigid steel reinforcing rod.

13. An apparatus according to claim 8, further comprising alignment line attaching means for attaching a flexible alignment line to the cross member, the attaching means adapted for positioning an alignment line onto the cross member, the attaching means mounted on the cross member and adapted for adjustable sliding movement therealong.

14. An apparatus according to claim 13, wherein the alignment line attaching means comprises:

a slide arm adapted for slidable movement along a surface of the cross member, the slide arm member having a slot passing through the slide arm member for receiving the line and positioning the line onto a surface portion of the cross member;

opposing flexible clamp arms extending from the slide arm, the clamp arms extending around a portion of the cross member for loosely receiving the member; and biasing means cooperating between the opposing clamp arms for clamping the arms against the cross member for frictional attachment thereto.

15. A method of positioning a foundation trench comprising the steps of:

placing multiple rectangular tubular members onto a supporting ground surface wherein holes within opposing longitudinal end portions of each tubular member are positioned for receiving an elongate rod and passing the rod transversely through the tubular member and generally vertically into the ground surface, the tubular members being located for defining ends of a foundation;

passing an elongate rod through the holes at each end of each tubular member;

driving the rod vertically into the ground;

raising the tubular member to a selected height above the ground surface;

releasably securing the tubular member to the rods passing therethrough by biasing the rods against cooperating hole walls;

placing a U-shape slide member onto the tubular member top surface, the slide member having a slot passing therethrough for guiding a flexible line along the tubular member top surface;

placing a flexible line within the slot;

passing the flexible line over a top side wall portion of a first tubular member and securing the line to that member;

pulling the line taut while passing the line over a top surface of a second tubular member, the second tubular member cooperating with the first member to define a trench edge running along the line;

sliding the slide member longitudinally along each tubular member until the slide member is at a selected position for defining the trench edge; and securing the slide member against the tubular member by biasing arms of the slide member against tubular side wall portions.

16. A method according to claim 15, further comprising the step of placing additional tubular members for cooperating in defining a foundation perimeter.

17. A method according to claim 15, further comprising the step of leveling the tubular member.

18. A method of positioning a foundation trench comprising the steps of:

placing multiple rectangular tubular members onto a supporting ground surface wherein holes within opposing longitudinal end portions of each tubular member having an eyebolt within each end for receiving an elongate rod through the holes and eyebolt, the tubular members being located for defining ends of a foundation;

passing an elongate rod through the holes at each end of each tubular member, the elongate rod further passing through the aperture within each eyebolt head;

driving each rod into the ground;

raising the tubular member to a selected height above the ground surface;

forcing the eyebolt along the tubular member longitudinal axis for biasing the rod against the cooperating hole side wall portions thus releasably securing the tubular member to each of the rods;

passing a flexible line over a top side wall portion of a first tubular member and securing the line to that member; and pulling the line taut while passing the line over a top surface of a second tubular member, the second tubular member cooperating with the first member to define a trench edge running along the line.

19. A construction alignment apparatus comprising:

a tubular member having a hole therein for passing an elongate rod transversely therethrough; and biasing means for biasing the elongate rod against the tubular member, the biasing means comprising a bolt having a threaded shaft and a head including an aperture therein for loosely receiving the elongate rod therethrough, the head positioned within the tubular member for receiving the rod within the aperture when the rod passes through the hole; and a nut threaded onto the shaft for driving the shaft and for biasing the rod passing through the aperture of the head against a hole side wall, the bolt moving from a first position wherein the elongate rod is loosely passing through the aperture and hole to a second position wherein the rod is biased against the hole side wall thus securing the rod to the tubular member.

20. An apparatus according to claim 19, wherein the biasing means further comprises an end cap held against a tube end, the end cap having a hole for receiving the shaft of the bolt, wherein driving the shaft longitudinally along the tubular member biases the nut against the end cap and thus the rod passing through the aperture against the hole side wall.

21. An apparatus according to claim 20, wherein the end cap further comprises guiding means cooperating with the bolt for limiting rotation of the bolt and permitting generally smooth passing of the rod through the hole and aperture.

22. An apparatus according to claim 19, further comprising an elongate rod adapted to be driven into the ground, the rod passing transversely through the tubular member for biasing against the hole side wall portions.

23. An apparatus according to claim 19, further comprising alignment line attaching means for attaching a flexible alignment line to the tubular member, the attaching means adapted for positioning the alignment line onto the tubular member, the attaching means mounted on the tubular member and adapted for adjustable sliding movement therealong.

* * * * *